US010111797B2

(12) United States Patent
Koch

(10) Patent No.: US 10,111,797 B2
(45) Date of Patent: Oct. 30, 2018

(54) DEVICE FOR HEIGHT ADJUSTMENT OF AN OPERATING TABLE

(71) Applicant: Maquet GmbH, Rastatt (DE)

(72) Inventor: Guido Koch, Karlsruhe (DE)

(73) Assignee: MAQUET GMBH, Rastatt (DE)

( * ) Notice: Subject to any disclaimer, the term of this patent is extended or adjusted under 35 U.S.C. 154(b) by 612 days.

(21) Appl. No.: 14/790,233

(22) Filed: Jul. 2, 2015

(65) Prior Publication Data

US 2016/0000628 A1 Jan. 7, 2016

(30) Foreign Application Priority Data

Jul. 4, 2014 (DE) ..... 10 2014 109 377

(51) Int. Cl.
*A61G 13/06* (2006.01)
*A61G 7/012* (2006.01)
(Continued)

(52) U.S. Cl.
CPC ..... *A61G 13/06* (2013.01); *A61G 7/012* (2013.01); *A61G 13/04* (2013.01); *A61G 13/08* (2013.01)

(58) Field of Classification Search
CPC ..... A61G 7/012; A61G 7/018; A61G 7/002; A61G 13/06; A61G 13/02
(Continued)

(56) References Cited

U.S. PATENT DOCUMENTS 2,059,130 A 10/1936 May
2,532,677 A 12/1950 Hyman
(Continued)

FOREIGN PATENT DOCUMENTS

CN 1392788 A 1/2003
CN 201147445 Y 11/2008
(Continued)

OTHER PUBLICATIONS

English translation of Chinese Office Action and Chinese Search Report dated Aug. 22, 2016 which issued during the prosecution of related Chinese Patent Application No. 201510387488.2, 9 pages.
(Continued)

*Primary Examiner* — Robert G Santos
(74) *Attorney, Agent, or Firm* — Kirk D. Swenson

(57) ABSTRACT

A device for height adjustment of an operating table, including a lifting carriage which is movable relative to a chassis of the operating table, including a primary guide having a first longitudinal axis about which the lifting carriage is rotatable, including a secondary guide having a second longitudinal axis, and including a guide means which is connected to the chassis of the operating table and which has a contact area in which the guide means contacts the secondary guide in a contact area of the secondary guide. The primary guide and the secondary guide serve for guiding a lifting motion of the lifting carriage within an adjustment range of the lifting carriage parallel to the first longitudinal axis, wherein a plane extending perpendicular to the first longitudinal axis and through the guide means has a first point of intersection with the first longitudinal axis and a second point of intersection with the second longitudinal axis, and wherein the position of the second point of intersection changes by a displacement distance during the lifting motion of the lifting carriage within the adjustment range thereof.

21 Claims, 8 Drawing Sheets

(51) Int. Cl.
*A61G 13/04* (2006.01)
*A61G 13/08* (2006.01)

(58) Field of Classification Search
USPC ..... 5/611, 11, 600
See application file for complete search history.

(56) References Cited

U.S. PATENT DOCUMENTS

| | | | | |
|---|---|---|---|---|
| 2,897,029 | A | 7/1959 | Maisel | |
| 3,042,131 | A | 7/1962 | Dovci | |
| 3,393,004 | A | 7/1968 | Earl | |
| 3,579,671 | A | 5/1971 | Koetter | |
| 3,739,406 | A | 6/1973 | Koetter | |
| 3,868,103 | A * | 2/1975 | Pageot | A61G 13/02 137/596 |
| 3,900,906 | A | 8/1975 | Berthelsen | |
| 4,572,493 | A * | 2/1986 | Hubert | A61G 13/02 5/608 |
| 4,589,642 | A * | 5/1986 | Schnelle | A61G 13/02 5/608 |
| 4,667,354 | A | 5/1987 | Carey, Jr. | |
| 4,912,787 | A | 4/1990 | Bradcovich | |
| 4,958,817 | A | 9/1990 | Heller | |
| 5,074,000 | A | 12/1991 | Soltani | |
| 5,181,288 | A | 1/1993 | Heaton | |
| 5,299,334 | A | 4/1994 | Gonzalez | |
| 5,398,356 | A * | 3/1995 | Pfleger | A61B 6/04 5/601 |
| 5,477,570 | A | 12/1995 | Hannant | |
| 5,528,782 | A | 6/1996 | Pfeuffer | |
| 5,621,933 | A | 4/1997 | Knapp et al. | |
| 5,624,375 | A | 4/1997 | Dykes | |
| 5,791,233 | A | 8/1998 | Knapp | |
| 6,505,364 | B2 * | 1/2003 | Simmons | A61G 13/06 108/150 |
| 6,640,363 | B1 | 11/2003 | Pattee | |
| 6,678,907 | B1 | 1/2004 | Voelker et al. | |
| 7,257,850 | B1 | 8/2007 | Tekulve | |
| 7,913,337 | B1 | 3/2011 | Masson | |
| 8,657,243 | B2 | 2/2014 | Marugg | |
| 8,677,529 | B2 | 3/2014 | Jackson | |
| 8,800,983 | B2 * | 8/2014 | Koch | A61G 13/02 248/652 |
| 9,295,598 | B2 | 3/2016 | Roussy | |
| 2002/0138903 | A1 * | 10/2002 | Simmons | A61G 13/06 5/600 |
| 2003/0074735 | A1 | 4/2003 | Zachrisson | |
| 2005/0015878 | A1 | 1/2005 | Bannister | |
| 2010/0211099 | A1 | 8/2010 | Radermacher | |
| 2010/0275371 | A1 | 11/2010 | Turner | |
| 2011/0010858 | A1 | 1/2011 | Tesar | |
| 2012/0216350 | A1 * | 8/2012 | Koch | A61G 13/04 5/607 |
| 2016/0000627 | A1 | 1/2016 | Jackson | |
| 2016/0000628 | A1 | 1/2016 | Koch | |
| 2016/0089287 | A1 | 3/2016 | Buerstner | |
| 2016/0095773 | A1 | 4/2016 | Ruch | |

FOREIGN PATENT DOCUMENTS

| | | | |
|---|---|---|---|
| CN | 102631271 | A | 8/2012 |
| CN | 103596538 | A | 2/2014 |
| CN | 103767847 | A | 5/2014 |
| DE | 1798342 | U | 10/1959 |
| DE | 1 928 624 | U | 12/1965 |
| DE | 43 41 779 | A1 | 6/1995 |
| DE | 44 23 402 | A1 | 1/1996 |
| DE | 196 23 580 | C2 | 12/1997 |
| DE | 10 2010 020 129 | A1 | 11/2011 |
| DE | 10 2010 051 126 | A1 | 5/2012 |
| DE | 10 2011 000 628 | A1 | 8/2012 |
| DE | 10 2011 103 546 | A1 | 12/2012 |
| GB | 1559945 | A | 1/1980 |
| JP | H08-182711 | A | 7/1996 |
| JP | H09-124277 | A | 5/1997 |
| JP | 2003-527921 | A | 9/2003 |
| JP | 2004-511289 | A | 4/2004 |
| JP | 2005-144174 | A | 6/2005 |
| JP | 2014-39593 | A | 6/2014 |
| JP | 5518960 | B2 | 6/2014 |

OTHER PUBLICATIONS

Japanese Office Action dated Jul. 12, 2016 which issued during the prosecution of corresponding Japanese Patent Application No. 2015-127480, 5 pages.
Extended European Search Report dated Nov. 4, 2015 issued for corresponding EP Patent Application No. 15171193.4, 6 pages.
Extended European Search Report dated Nov. 4, 2015 issued for related EP Patent Application No. 15171179.3, 7 pages.
Extended European Search Report dated Nov. 4, 2015 issued for related EP Patent Application No. 15171217.1, 7 pages.
Chinese Office Action and Chinese Search Report (including English translation) dated Oct. 9, 2016 which issued during the prosecution of corresponding Chinese Patent Application No. 201510378762.X, 8 pages.

* cited by examiner

DEVICE FOR HEIGHT ADJUSTMENT OF AN OPERATING TABLE

CROSS REFERENCE TO RELATED APPLICATIONS

Applicant hereby claims foreign priority benefits under U.S.C. § 119 from German Patent Application No. DE 10 2014 109 377.1 filed on Jul. 4, 2014, the contents of which are incorporated by reference herein.

TECHNICAL FIELD

The invention relates to a device for height adjustment of an operating table, comprising a lifting carriage which is movable relative to a chassis of the operating table. Further, the invention relates to an operating table including a device of this type for height adjustment of a patient support wherein the patient support is connected to a column head of the operating table and wherein the height of the column head is variable by means of the lifting carriage.

BACKGROUND

Prior to and during an operation of a patient placed on the patient support, the patient support is brought to a position which facilitates a surgical intervention on the patient. For this purpose, pivoting of the patient support by large angles may be required. Also the height of the operating table's patient support should be adjustable within a range as wide as possible. The operating table ideally further allows even for very small heights of the patient support, which requires compact construction of the operating table column.

The following three different types of operating tables are typically used in hospitals: stationary operating tables, movable operating and mobile operating tables. Stationary operating tables have an operating table column permanently fixed to the floor of an operating room, they normally do not comprise an operating table base, and energy is supplied to them via fixedly installed cables. With these stationary operating tables, the patient support can easily be detached and re-attached and is transportable by means of a dedicated transport apparatus. With this transport apparatus, a patient resting on the patient support can be transported to and away from the operating room.

Movable operating tables have an operating table base connected to the operating table column and allowing for free positioning in the operating room, and a patient support which can be detached from and re-attached to the operating table column. Moving of the operating table column is performed by means of a column transporter provided therefore, or, in the case of self-mobile movable operating tables, by means of incorporated extractable transport rollers.

Operating table bases of mobile operating tables include rollers for moving the operating table such that they can be moved without auxiliary means and are suited for transporting a patient. Further, with mobile operating tables, the patient support usually is coupled to the operating table column and is not separated from the operating table column in hospital practice.

Stationary operating tables as well as movable operating tables or mobile operating tables may employ components which can be adjusted by means of an electric motor, such as an operating table column which is length adjustable by means of an electric motor for height variation of a patient support attached to the operating table column, an operating table column head which is adjustable about two orthogonal axes for variation of tilt and swing of the patient support connected to the operating table column head, and/or components of the patient support that can be adjusted by means of an electric motor.

In particular during a surgical intervention on the patient, the operating table has to be supported in a stable and precise manner. For example, it must be capable of holding exterior forces and torques caused by lateral forces or by a change of the position of the patient's and the patient support's center of gravity without yielding noticeably. On the other hand, it must be guided in a manner so precise that height adjustment is possible without jamming of the elements provided for height adjustment.

For adjusting the height of an operating table column sliding guides are known having circular as well as non-circular cross sections. Great manufacturing efforts are required for producing a guide with non-circular cross section having only small clearance. Small clearance, however, is required for achieving high rigidity of the operating table. Use of a sliding guide with circular cross section has a disadvantage in that the element sliding on the guide may rotate about the longitudinal axis of the guide. In order to avoid such rotation, keys may be provided that engage in a groove and are arranged at the sliding element or the guide, respectively, and that accommodate torques acting about the longitudinal axis of the guide. This makes the production expensive and complex. Furthermore, the distance of the anti-twist protection is limited to the radius of the circular guide and requires great guide diameters for achieving the desired rigidity. In the case of an alternative construction, wherein two circular guides are arranged parallel to one another, the element sliding on the circular guides tends to jam when the typical manufacturing and mounting tolerances are considered.

SUMMARY

It is the object of the invention to specify a device for height adjustment of an operating table as well as an operating table which have a simple structure and which securely accomodate even lateral forces and torques.

This object is achieved, according to a first aspect, by a device including a lifting carriage which is movable relative to a chassis of the operating table, including a primary guide having a first longitudinal axis (L1) about which the lifting carriage is rotatable, including a secondary guide having a second longitudinal axis (L2), and including a guide means which is connected to the chassis of the operating table and which has a contact area in which the guide means contacts the secondary guide in a contact area of the secondary guide, wherein the primary guide and the secondary guide serve for guiding a lifting motion of the lifting carriage within an adjustment range of the lifting carriage parallel to the first longitudinal axis (L1), wherein a plane (E) extending perpendicular to the first longitudinal axis (L1) and through the guide means has a first point of intersection (S1) with the first longitudinal axis (L1) and a second point of intersection (S2) with the second longitudinal axis (L2), wherein the position (P1, P2) of the second point of intersection (S2) changes by a displacement distance during the lifting motion of the lifting carriage within the adjustment range thereof, and wherein the connection between the guide means and the chassis permits a complementing motion of the guide means such that the contact area of the guide means is shiftable by said displacement distance as well as by an operating table having a device for height adjustment of a patient support according to one of the preceding claims, wherein the patient support is connected to a column head of the operating table, and wherein the height of the column head is variable by means of the lifting carriage.

By means of such a device, it is achieved that the secondary guide and the primary guide can be formed as circular guides which can be produced in an easy manner. The above-mentioned problem of jamming or canting of the lifting carriage having the circular guides mentioned is avoided by permitting a compensating motion of the guide means. By means of the compensating motion, manufacturing and mounting tolerances may be compensated for. At the same time, contact between the guide means and the secondary guide ensures that the secondary guide provides a guiding function for the lifting carriage. A patient support may be coupled to the lifting carriage via further elements, such as a column head, such that a height adjustment of the operating table's patient support is performed upon a vertical movement of the lifting carriage.

The longitudinal axis of the secondary guide and the longitudinal axis of the primary guide are parallel within the manufacturing tolerances and the mounting tolerances. By means of the solution according to the invention, it is particularly achieved that the function of the device is not affected by deviations in parallelism of the longitudinal axes of primary and secondary guide that are unavoidable due to the tolerances of current manufacturing processes. The guide means is capable of compensating for positional changes of the second point of intersection due to the manufacturing and mounting tolerances. The path of displacement by which the contact area of the guide means moves in this connection, may be straight or curved. If the primary guide is formed as a multi-part element, or if a natural definition of a longitudinal axis is impossible, the longitudinal axis of the primary guide is defined as the guiding axis along which the lifting carriage is guided during a lifting motion of the lifting carriage.

It is further advantageous if the position of the second point of intersection changes from a first position prior to the lifting motion of the lifting carriage to a second position after the lifting motion of the lifting carriage, and if upon a displacement of the second point of intersection from the first position to the second position, the contact area of the guide means is moved together with the secondary guide during the compensating motion. Thereby, changes in the distance between the primary guide and the secondary guide in the amount of the distance between the two positions are compensated for by the guide means. Preferably, the maximum tolerance regarding the parallelism of the primary and secondary guide and the changes in distance in the plane resulting therefrom that can be compensated for by means of the connection of the guide means is in the range of 0 mm to 3 mm, in particular 0 mm to 1 mm.

It is further advantageous if an X-axis lies in the plane, and an Y-axis lies in the plane orthogonal to the X-axis, with the X-axis intersecting the first longitudinal axis and the second longitudinal axis, and if the connection between the guide means and the chassis permits the compensating motion along a path between the first position and the second position such that the length of the projection onto the Y-axis of the distance between the first position and the second position is smaller than the length of the projection onto the X-axis of the distance between the first position and the second position. This ensures that the lifting carriage rests on the secondary guide without clearance, opposing pivoting about the first longitudinal axis, and thus achieving the required rigidity.

Preferably, the path follows a functional connection between the X-axis and the Y-axis. This means that the path results from the fact that to each value on the X-axis there is assigned exactly one value on the Y-axis. Preferably, the X-axis and the Y-axis are axes of a two-dimensional Cartesian coordinate system, wherein the coordinate system is right-handed and the X-axis extends such that the point of intersection between the longitudinal axis of the secondary guide and the plane has a positive value on the X-axis.

If X-axis and Y-axis are part of a coordinate system, the distance between the first position and the second position may be determined in X-direction and in Y-direction. Preferably, the distance in Y-direction between the first position and the second position is 0% to 10% of the distance in X-direction. Due to the fact that the path of the movement of the guide element between the first position and the second position is considerably smaller in Y-direction than in X-direction, no user- or patient-recognizable rotation of the lifting carriage occurs about the first longitudinal axis when compensating for distance tolerances. For example, the first position of the second point of intersection may be defined by the point of intersection between the second longitudinal axis and the plane prior to the lifting motion from a lowermost position of the lifting carriage within the adjustment range thereof, and the second position of the second point of intersection may be defined by the point of intersection between the second longitudinal axis and the plane after the lifting motion from the lowermost position of the lifting carriage to the uppermost position within the range of adjustment thereof.

Further, it is advantageous if the connection between the guide means and the chassis permits the compensating motion of the guide means only in such a way that upon the lifting motion of the lifting carriage within the adjustment range thereof, the second point of intersection moves on a predetermined trajectory in the plane. Thereby, higher rigidity of the operating table is achieved, and jamming of the lifting carriage on the primary and secondary guide is prevented by permitting the desired movement of the point of intersection.

The course of the trajectory may be straight or curved, in particular circular. Preferably, the trajectory is a one-dimensional path in the plane. In particular, the course of the trajectory has a greater share along the X-axis than along the Y-axis at any point of its path.

Further, it is advantageous if the path of the movement of the guide element is considerably smaller in Y-direction than in X-direction, since in case of a movement in X-direction for compensation of distance tolerances, there is no visible rotation of the lifting carriage about the first longitudinal axis.

Further, it is advantageous if the primary guide comprises a guide bar and a guiding bush arranged in the chassis, wherein the first longitudinal axis is the axis of the guide bar. At each of a first end and a second end opposite the first end, the guide bar is fixedly connected to the lifting carriage and is moved together with the lifting carriage during the lifting movement thereof. The guide bar is fed through the guiding bush in a sliding manner. Further, the secondary guide comprises a guide element formed as a rod or a cylinder barrel, wherein each of a first end of the guide element and a second end of the guide element opposite the first end is fixedly connected to the lifting carriage. The guide element is fed through the contact area of the guide means in a sliding manner. Thereby, secure guiding of the lifting carriage by means of the primary guide is achieved. Therein, the guiding bush of the primary guide is preferably formed as a bearing bush. Furthermore, it is not necessary to provide for long guide elements in the operating table that, for example, limit the minimum lifting height of a patient support of the operating table. Further, a simple robust structure and secure guiding of the guide element by means of the secondary guide through the aperture of the guide means are achieved.

Further, it is advantageous if the guide bar has a circular cross section with a diameter within the range of 25 mm to 80 mm, preferably 50 mm. The use of a primary guide of this type allows for transmission of substantially any supporting forces to be induced from the lifting carriage to the chassis without deforming or distorting the guide bar to such an extent that there is a risk of the lifting carriage jamming when performing a sliding motion along the primary guide.

Further, it is advantageous if the main guide has at least one contact area via which the guiding bush contacts the guide bar, wherein the contact area of the primary guide has a length within the range of 120 mm to 210 mm, preferably 170 mm, parallel to the first longitudinal axis. Thereby, it is ensured that torques can be transferred from the lifting carriage to the chassis with small clearance.

In a further development, the secondary guide is formed by a cylinder barrel of a lifting cylinder serving as drive for the lifting carriage, and one end of the piston rod of the lifting cylinder is fixedly connected to the chassis of the operating table. Therefore, no further element is required for driving the lifting carriage, besides the primary guide and the lifting carriage drive. In case the lifting carriage drive is, for example, formed as a screw gearing, the lifting carriage drive is rotatably connected to the lifting carriage.

Further, it is advantageous if the guide means has a first aperture forming the contact area of the guide means through which a portion of the secondary guide is fed in a sliding manner. Thereby, secure guiding of the secondary guide is guaranteed in a particularly simple way.

Further, it is advantageous if the first aperture of the guide means and a portion of the secondary guide form a slide bushing via which the secondary guide is movable along the first longitudinal axis relative to the guide means. Thereby, secure guiding of the secondary guide via the guide means is realized in a particularly simple manner.

Further, it is advantageous if the lifting carriage drive is a lifting cylinder, preferably a double-acting and/or a hydraulic cylinder, and if a portion of the lateral surface of the cylinder barrel is fed through the first aperture of the guide means in a sliding manner. Thereby, the lifting carriage drive is capable of both, lifting and actively lowering the lifting carriage in an advantageous manner.

In a particularly advantageous further development of the invention, the guide means is connected to the chassis of the operating table so as to be pivotable about a rotational axis parallel to the first longitudinal axis. In a neutral position of the guide means, a radial axis lying in the plane and intersecting both, the rotational axis and the second longitudinal axis at right angles, is parallel to the X-axis. By means of this development, a compensating motion along the X-axis by the guide means may be performed in a particularly easy manner, and at the same time a compensating motion of the guide means relative to the chassis of the operating table along the Y-axis can be prevented or be permitted only to a small extent. In other embodiments, the radial axis intersects the X-axis within a range of 80° and 100°, preferably 85° and 95°.

Further, it is advantageous if the allowed manufacturing and mounting tolerances are limited such that, upon the compensating motion of the guide means, the maximum length of the projection onto the X-axis of the distance between the first position and the second position has a value in the range of 0 mm to 3 mm, preferably in the range of 0 mm to 1 mm. Thereby, limitation of the displacement length is possible in a simple manner.

Further, it is advantageous if the only compensating motion allowed for by the connection of the guide means to the chassis upon a lifting movement of the lifting carriage in the plane extends along a line connecting the first point of intersection and the second point of intersection. This increases rigidity of the lifting carriage with respect to torques in the plane perpendicular to the X-axis, or an axis parallel thereto, and at the same maintains the required compensating motion along the X-axis.

In another advantageous development of the invention, there are provided a first linear actuator and a second linear actuator, wherein the lifting carriage is connected to each of a first end of the first linear actuator and a first end of the second linear actuator for adjustment of height and/or tilt of the column head of the operating table. By this means, the functions of height adjustment of the column head and tilt adjustment of the column head can be advantageously coupled. Therein, the first and second linear actuators preferably are the only operative mechanical connection between the lifting carriage and the column head. The patient support of the operating table is coupled to the column head, with a vertical movement of the lifting carriage causing a height variation of the patient support.

A second aspect of the invention relates to an operating table comprising a device for height adjustment of a patient support. In the operating table, the patient support is connected to a column head of the operating table wherein the height of the column head can be varied via the vertical movement of the lifting carriage. By providing the height adjustment device as part of an operating table, the typical demands of a surgeon on an operating table are met while stability of the total system is guaranteed.

BRIEF DESCRIPTION OF THE DRAWINGS

Further features and advantages of the invention result from the following description which in connection with the enclosed Figures explains the invention in more detail with reference to embodiments.

DETAILED DESCRIPTION

Figure 1:
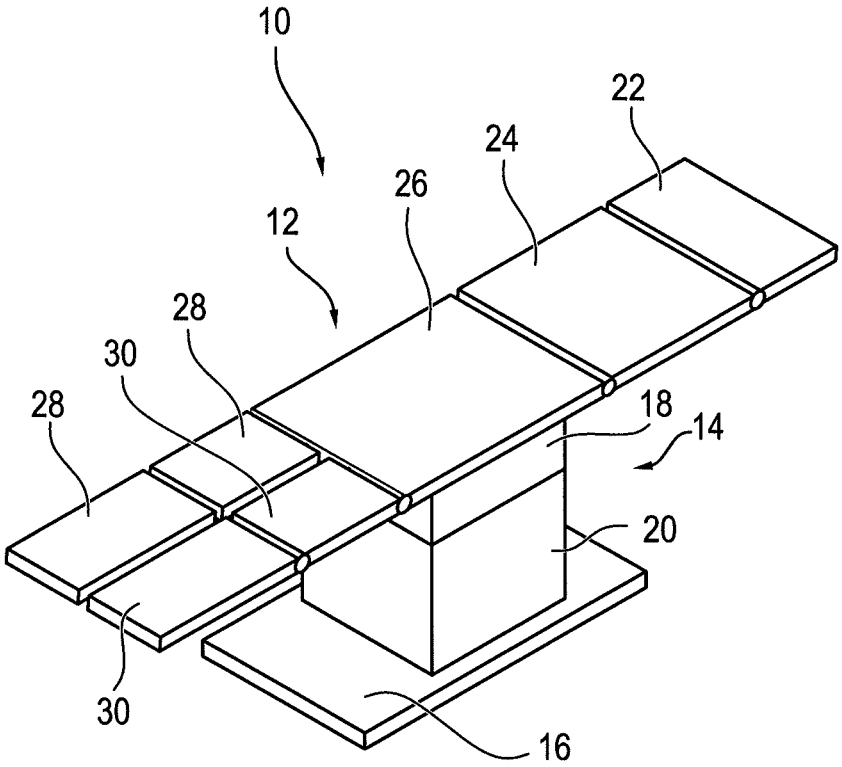
FIG. 1 shows a schematic illustration of an operating table according to a first embodiment.

FIG. 1 is a schematic illustration of an operating table 10 according to a first embodiment. The operating table 10 comprises a patient support 12, an operating table column 14, and an operating table base 16. The operating table column 14 includes a column head 18 and a basic body 20.

The patient support 12 includes a plurality of components whose position relative to one another can be adjusted to allow for different positioning of a patient not shown. In the present embodiment, the patient support 12 includes a seat panel 26, a back panel 24, a head panel 22, a two-piece right leg panel 28, and a two-piece left leg panel 30.

Figure 2:
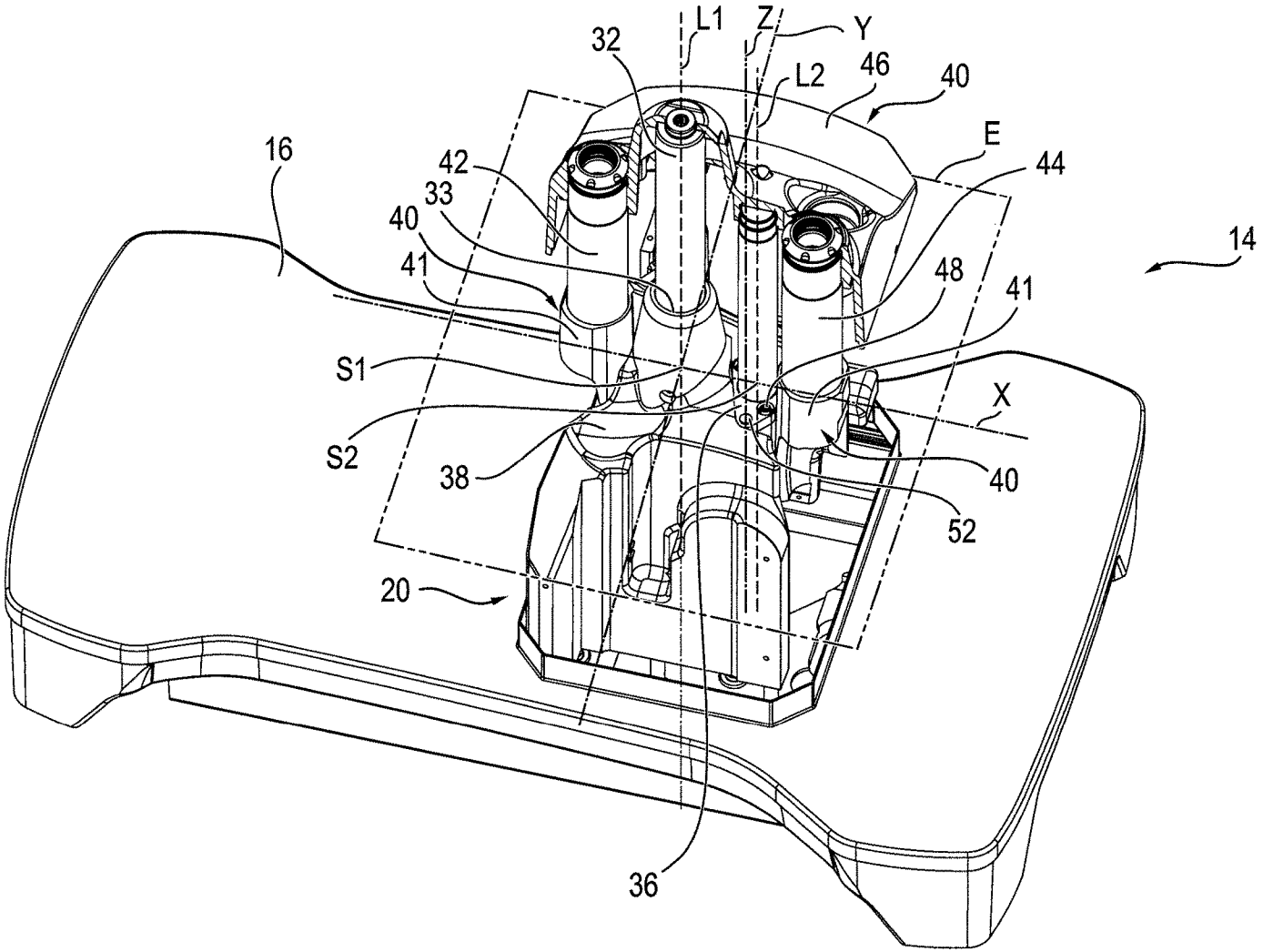
FIG. 2 shows a detailed perspective lateral view of the operating table base and an operating table column of the operating table wherein covering elements of the operating table column are not shown such that a guide means for guiding a lifting carriage drive is visible.

FIG. 2 is a detailed perspective lateral view of the operating table base 16 and the operating table column 14 of the operating table 10 wherein covering elements of the operating table column 14 are not shown. Elements having the same structure or the same function are designated by identical reference numbers.

The operating table column 14 includes a lifting carriage 40 which is slidable in a vertical direction by means of a lifting cylinder 34. The lifting carriage 40 is connected to the column head 18 and to the patient support 12 coupled thereto via two parallel linear actuators 42, 44. A vertical movement of the lifting carriage 40 leads to height variation of the column head 18 and thus height variation of the patient support 12.

During a vertical movement for height adjustment, the lifting carriage 40 is guided by a circular guide bar 32 of a primary guide. The guide bar 32 has a first vertically oriented longitudinal axis L1 about which the lifting carriage 40 is rotatably supported and along which it is guided during a vertical movement.

The lifting carriage 40 comprises a lower part 41 and an upper part 46. The upper part 46 is shown as a sectional view in a vertical plane in FIG. 2. The upper end of the guide bar 32 is fixedly connected to the upper part 46 of the lifting carriage 40, and the lower part of the guide bar 32 is fixedly connected to the lower part 41 of the lifting carriage 40. A chassis 38, also referred to as a basic body of the operating table column 14, includes a guiding bush 33 through which the guide bar 32 is fed so as to be supported in a sliding manner. The guide bar 32 substantially accommodates any lateral forces acting on the lifting carriage 40, and induces them into the chassis 38 via the guiding bush 33.

The lifting cylinder 34 is a hydraulic cylinder including a cylinder barrel 34*a* and a piston rod 34*b*. Inside the operating table base 16, the lower end of the piston rod 34*b* is fixedly connected to the chassis 38 of the operating table column 14 such that the cylinder barrel 34*a* can be extended in the upward direction. At its lower end, the cylinder barrel 34*a* is fixedly connected to the lower part 41 of the lifting carriage via a connecting area, and at its upper end, the cylinder barrel 34*a* is fixedly connected to the upper part 46 of the lifting carriage 40.

The vertical movement of the cylinder barrel 34*a* during an actuating motion of the lifting cylinder 34 is guided by a guide means 36. Thus, the cylinder barrel 34*a* serves as a secondary guide. The longitudinal axis L2 of the cylinder barrel 34*a* is oriented parallel to the first longitudinal axis L1 within the manufacturing and mounting tolerances. The secondary guide prevents rotation of the lifting carriage 40 about the first longitudinal axis L1 and accommodates the torques acting on the lifting carriage 40 about the first longitudinal axis L1. In the present embodiment, the lifting cylinder 34 is formed as a double-acting hydraulic cylinder 34. In other embodiments, other linear actuators may be employed as lifting carriage drive 34.

In a plane E which is perpendicular to the longitudinal axes L1 and L2 there extends an axis X which is referred to as X-axis in the flowing and which intersects the longitudinal axis L1 at the point of intersection S1 and the longitudinal axis L2 at the point of intersection S2, each at right angles, when the guide means 36, and thus the cylinder barrel 34*a* are in a neutral position. Further, an axis Y extends in the plane, said axis being referred to as Y-axis in the following and being perpendicular to the X-axis and intersecting the longitudinal axis L1.

The guide means 36 has a circular aperture through which the cylinder barrel 34*a* of the lifting cylinder 34 is fed. The guide means 36 is rotatably supported at the chassis 38 via a pivot bearing 52, and is connected to the chassis 38, and thus via the chassis 38 with the guiding bush 33, via two screw connections, with the first screw connection 48 being clearly visible. The rotational axis of the pivot bearing 52 is designated by Z and is parallel to the longitudinal axis L1 of the guide bar 32. The connection of the guide means 36 with the chassis via the two screw connections 48 and the pivot bearing 52 allows a movement of the cylinder barrel 34*a* in the plane E along the X-axis, with a maximum length within the range 0 mm to 1 mm. Formation of the first screw connection 48 and the second screw connection 50 will be described in more detail in connection with FIG. 6.

The guide means 36 is arranged such that in the neutral position of the guide means 36 a radial axis R intersecting the rotational axis Z of the pivot bearing 52 and the longitudinal axis L2 of the cylinder barrel 34*a* at right angles is parallel to the Y-axis. Thereby, the cylinder barrel 34*a* of the lifting cylinder 34 is guided by the guide means 36 such that the intersecting plane of the cylinder barrel 34*a* and the plane E is not shiftable in the plane E along the radial axis R, or is shiftable less than along X-axis. As a consequence, a force acting on the lifting carriage 40 from the lateral direction parallel to the Y-axis is induced into the chassis 38 via the cylinder barrel 34*a* and the guide means 36.

During an adjusting motion of the lifting cylinder 34 along the longitudinal axis L1, an inevitable movement along the X-axis of the point of intersection S2 of the longitudinal axis L2 of the lifting cylinder 34 with the plane E relative to the point of intersection S1 of the longitudinal axis L1 of the guide bar 32 with the plane E cannot be prevented due to manufacturing and mounting tolerances. In the operating table column 10, jamming of the cylinder barrel 34*a* on the guide means 36 of the lifting carriage 40, which is additionally guided on the primary guide, is prevented by the movement of the aperture of the guide means 36 in direction of the X-axis such that a positional change of the point of intersection S2 from a first position to a second position is possible. By means of the guide bar 32 and the guiding bush 33 of the primary guide, forces acting on the lifting carriage 40 from a lateral direction parallel to the X-axis are accommodated by the primary guide and transmitted to the chassis 38.

The first linear actuator 42 and the second linear actuator 44 each comprise a cylinder barrel and a piston rod. Via a connecting area, the cylinder barrels of the first linear actuator 42 and the second linear actuator 44 are each received at their respective lower end in dedicated accommodating apertures provided in the lower part 41 of the lifting carriage 40, and are fixedly connected to the lower part 41 of the lifting carriage 40 thereby. Via a connecting area, the upper ends of the cylinder barrels of the first linear actuator 42 and the second linear actuator 44 are each received in dedicated accommodating apertures provided in the upper part 46 of the lifting carriage 40, and are fixedly connected to the upper part 46 of the lifting carriage 40 thereby. The upper end of the upward-extendable piston rod of the first actuator 42 and the upper end of the upward-extendable piston rod of the second actuator 44 are each connected to the column head 18. The piston rods are not shown in FIG. 2. The upper part 46 and the lower part 41 of the lifting carriage 40 are thus fixedly connected to one another via the cylinder barrel 34*a* and the guide bar 32 and the cylinder barrels of the linear actuators 42, 44.

Figure 3:
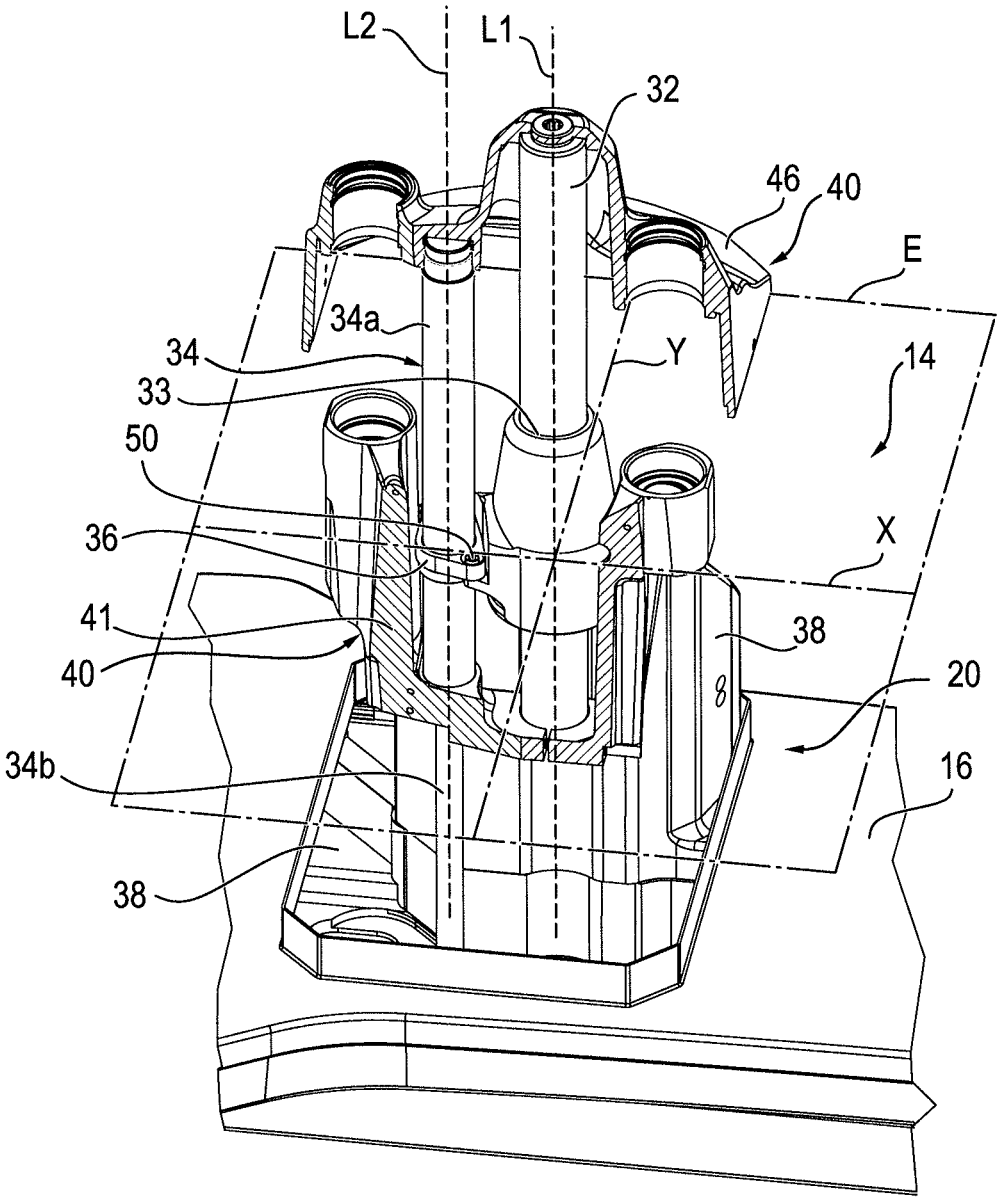
FIG. 3 is a detailed perspective lateral view of a portion of the operating table base and the operating table column according to FIG. 2, viewed from the direction opposite to that of FIG. 2, wherein further elements are removed.
Figure 4:
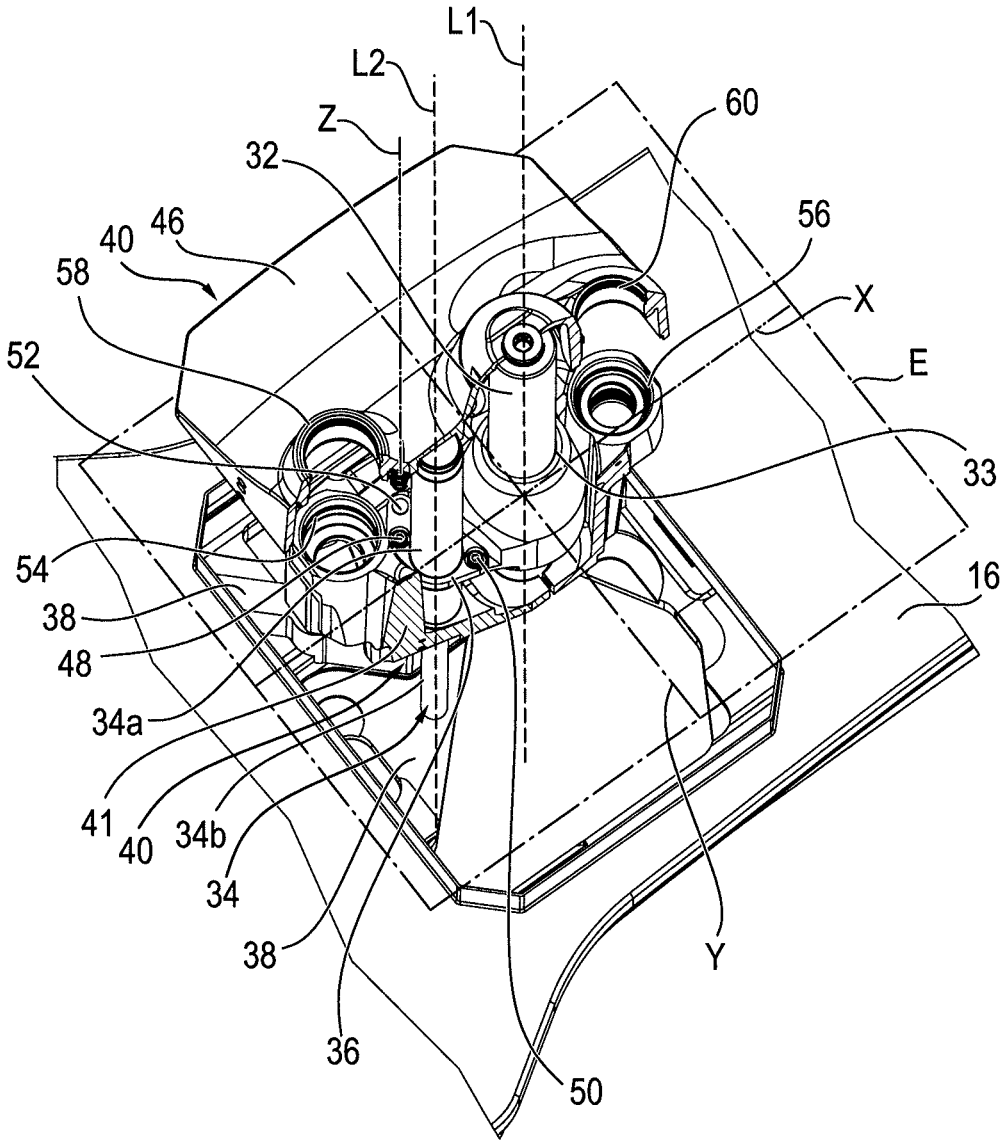
FIG. 4 is a detailed perspective plan view of the arrangement according to FIG. 3.

FIG. 3 is a detailed perspective lateral view of a detail of the operating table base 16 and the operating table column 14 according to FIG. 2 as seen from the direction opposite that of FIG. 2, wherein the linear actuators 42, 44 are not shown at all, and the upper part 46 and the lower part 41 of the lifting carriage 40 are shown in a vertical plane sectional view. In addition to the elements clearly visible in FIG. 2, a second screw connection 50 of the guide means 36 is shown, by means of which the guide means 36 is connected to the chassis 38. FIG. 4 is a detailed perspective plan view of the arrangement according to FIG. 3. This view in particular shows the fixation of a piston rod 34*b* of the lifting cylinder 34. The piston rod 34*b* is fixedly connected to the chassis 38 with the lower end thereof in the operating table base 16.

FIG. 4 further clearly shows the spatial arrangement of the guide means 36 with respect to the X-axis and the Y-axis in the plane E. A pivoting motion of the guide means 36 about the rotational axis Z, in particular in the case of small rotational angles, allows only a small movement of the area of intersection of the lifting cylinder 34 with the plane E in direction of an axis parallel to the Y-axis. During a rotation of the guide means 36 about the axis Z, the position of the point of intersection S2 of the longitudinal axis L2 of the cylinder barrel 34*a* preferably changes by a maximum length within the range of 0 mm to 1 mm in the direction of the X-axis.

Figures 5A, 5B:
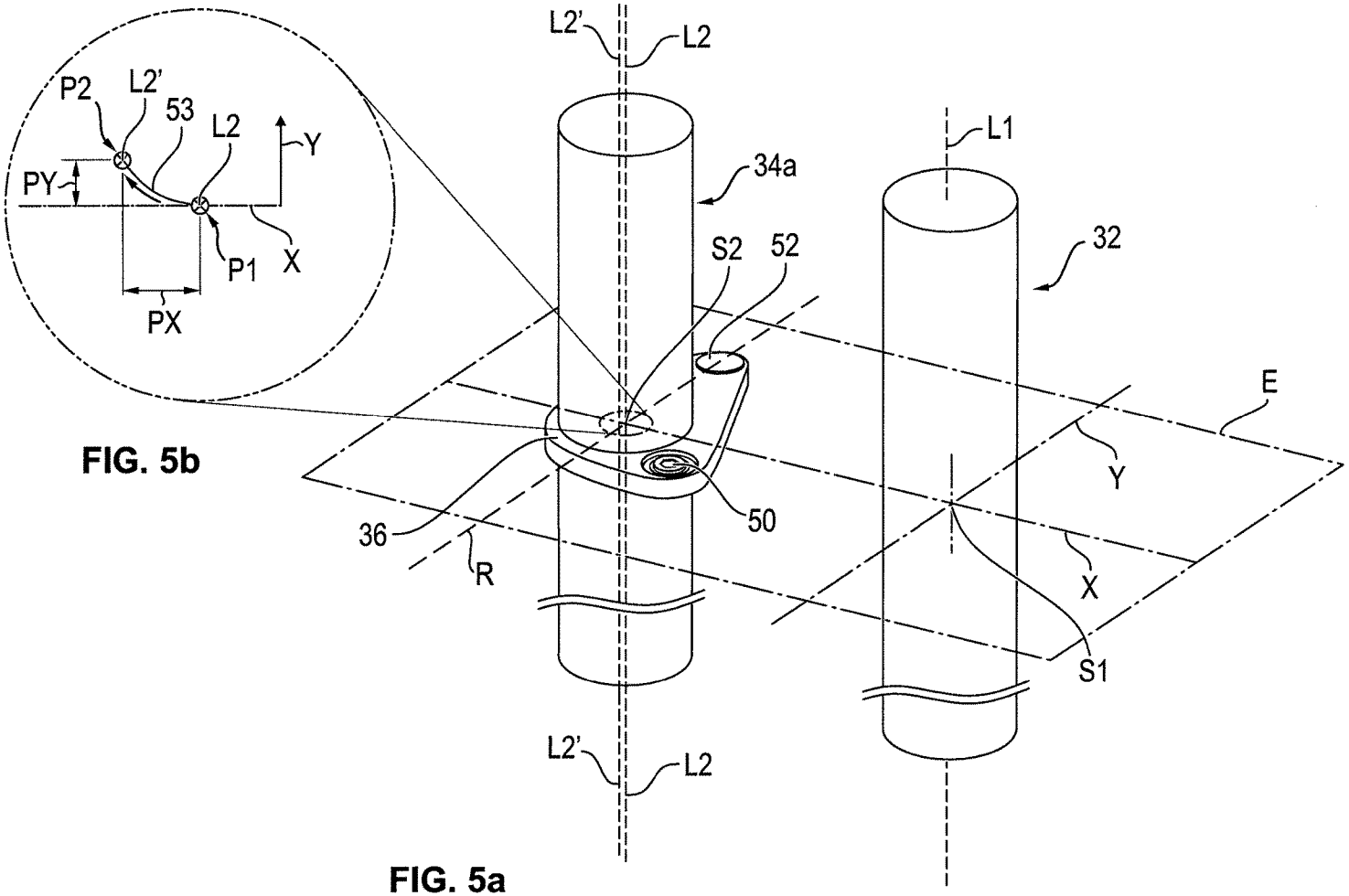
FIG. 5*a* is a schematic perspective lateral view of a primary guide, a lifting carriage drive, and a guide means.
FIG. 5*b* is an enlarged detail of FIG. 5*a;*

FIG. 5*a* is a schematic perspective lateral view of the guide bar 32, the cylinder barrel 34*a* of the lifting cylinder 34, and the guide means 36. FIG. 5*b* shows an enlarged detail of FIG. 5*a*. The cylinder barrel 34*a* of the lifting cylinder 34 is laterally guided by the guide means 36 such that changes of the position of the point of intersection S2 of the longitudinal axis L2 with the plane E have a greater share on along the X-axis than along the Y-axis. In the first position which is designated by P1 in FIG. 5*b*, the point of intersection S2 of the longitudinal axis L2 with the plane E prior to a lifting motion of the lifting carriage 40 lies on the X-axis. After the lifting cylinder 34 has performed the lifting motion, the point of intersection S2 of the longitudinal axis, now designated by L2', of the cylinder barrel 34*a* with the plane E is located at the second position, designated by P2 in FIG. 5*b*. The first position P1 has also been referred to as neutral position above.

During the lifting motion, the point of intersection S2 of the second longitudinal axis L2 covers a distance 53 in the plane E and moves along the direction of the arrow. Of the distance between the first position P1 and the second position P2, the projection onto the X-axis is designated by PX, and the projection onto the Y-axis is designated by PY. In particular, the length of PY is smaller than the length of PX.

Figure 6:
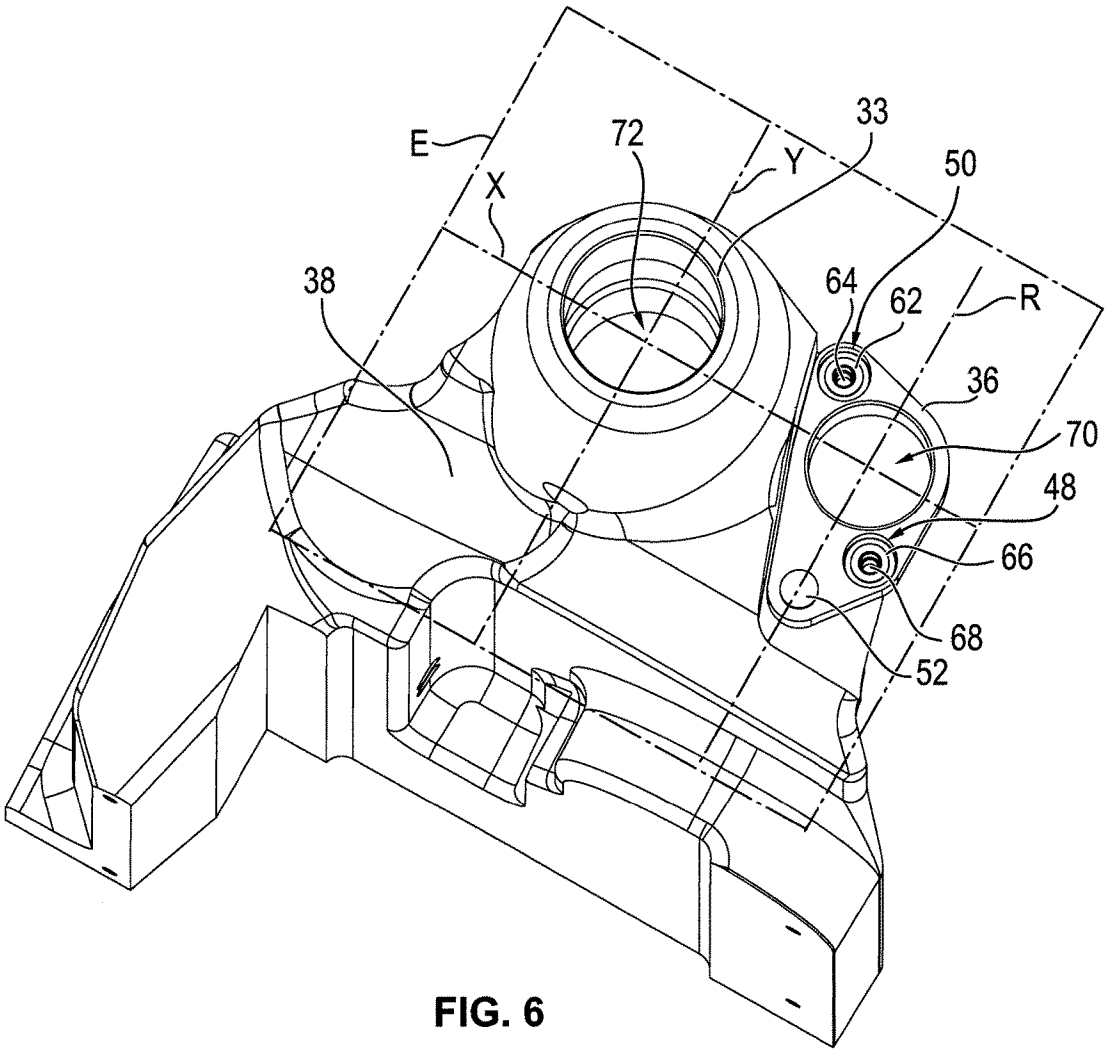
FIG. 6 is a perspective plan view of the guide means connected to a portion of the operating table chassis.

FIG. 6 is a perspective plan view of the operating table column 14 wherein the guiding bush 33 provided in the chassis 38 and the guide means 36 connected to the chassis 38 are shown. In particular, details of the first screw connection 48 and the second screw connection 50 are shown in this illustration. What is visible are a first disk spring 62 and a first female thread 64 provided in the chassis 38 for receiving a first screw, and a second disk spring 66 and a second female thread 68 for receiving a second screw. The screws are not shown. The first disk spring 62 is located between a screw head (not shown) of the first screw and a supporting surface the guide means 36.

The first screw not shown is screwed into the first female thread 64 in the chassis 38. Therein, the nominal diameter of the first screw is smaller than the diameter of the through hole formed in the guide means 36 such that the guide means 36 is capable of moving relative to the first screw. The lower side of the disk spring 62 is pressed onto the corresponding first supporting surface of the guide means 36 and can slide on said supporting surface such that the guide means 36 is capable of performing a compensating motion in the plane E with a maximum length within the range of 0 mm to 1 mm. The first supporting surface is formed by a step in the aperture provided for the first screw.

The second screw not shown is screwed into the second female thread 68 in the chassis 38. Therein, the nominal diameter of the second screw is smaller than the diameter of the through hole formed in the guide means 36 such that the guide means 36 is capable of moving relative to the second screw. The lower side of the second disk spring 66 is pressed onto the corresponding second supporting surface of the guide means 36 and can slide on said supporting surface such that the guide means 36 is capable of performing a compensating motion in the plane E with a maximum length within the range of 0 mm to 1 mm. The second supporting surface is formed by a step in the aperture provided for the second screw.

This illustration also shows the positioning of the guide means 36 with respect to the X-axis and the Y-axis by means of the indicated radial axis R. The radial axis R lies in the plane E and extends through the pivot bearing 52 and the center of the circular guiding aperture 70 of the guide means 36. In the illustrated neutral position of the guide means 36, the radial axis R is perpendicular to the X-axis.

FIG. 6 further shows a through hole 72 of the guiding bush 33 through which the guide bar 32 is fed.

Figure 7:
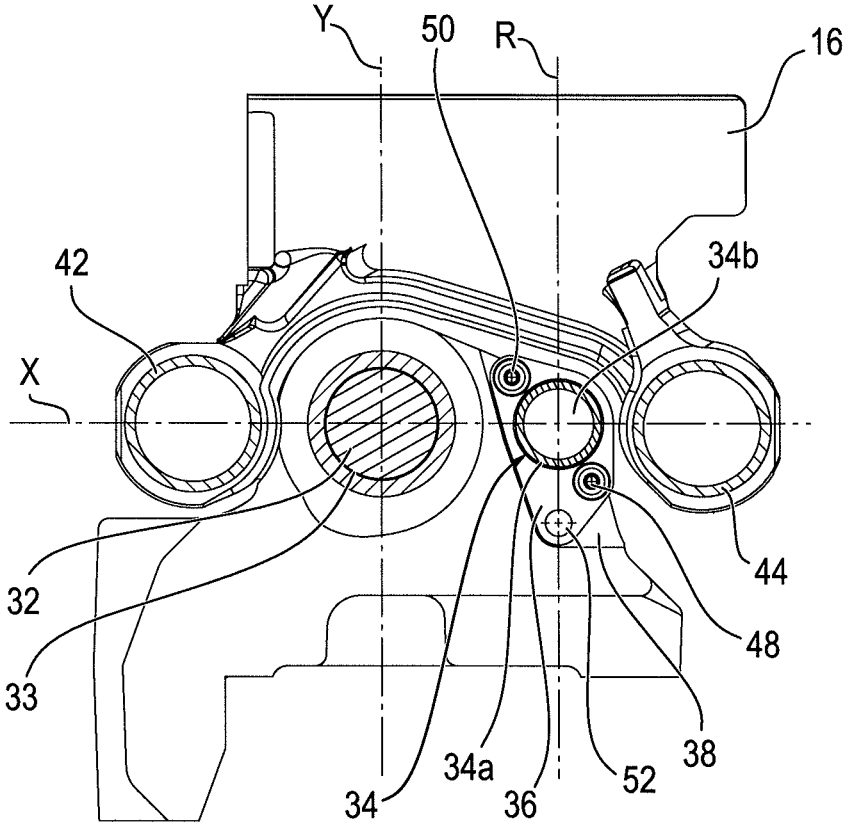
FIG. 7 is a plan view of the cross section of the operating table column above the guide means.

FIG. 7 is a plan view of the cross section of the operating table column 14 above the guide means 36. In addition to the elements shown in FIG. 6, this Figure also shows the first linear actuator 42, the second linear actuator 44 and the guide bar 32. This illustration clearly shows the positions of the guide bar 32, the lifting cylinder 34 and the guide means 36. The guide means 36 is arranged such that the radial axis R is parallel to the Y-axis. Thus, the cylinder barrel 34*a* is supported in way not slidable along the radial axis R. Thus, the lifting carriage 40 fixedly connected to the cylinder barrel 34*a* is in particular not capable of performing rotations about the longitudinal axis L1 of the guide bar 32. By means of a lifting motion of the lifting cylinder 34 guided by the guide means 36, the guide means 36 can be moved along the X-axis in the plane E.

Figure 8:
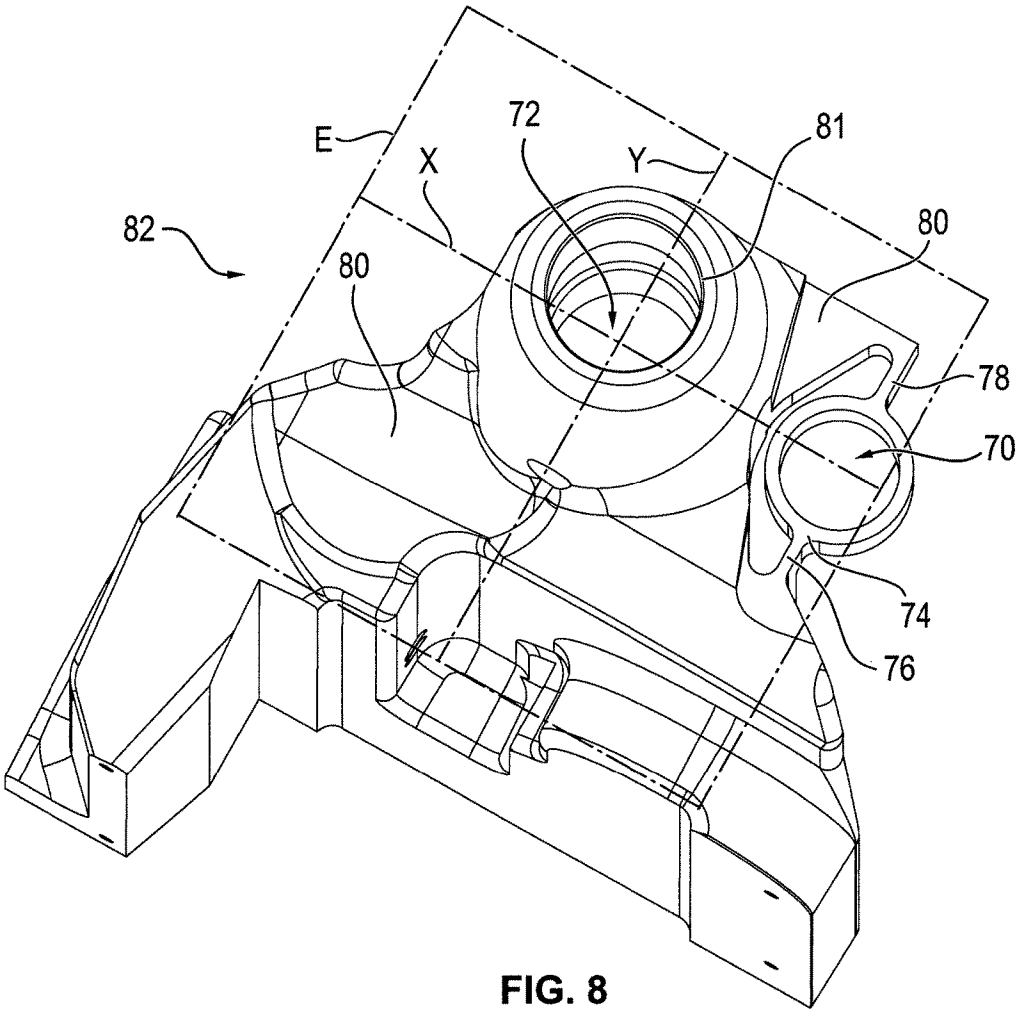
FIG. 8 is a perspective plan view of a portion of another chassis of another operating table, another guiding bush and another guide means for guiding a lifting carriage drive, according to a second embodiment.

FIG. 8 is a perspective plan of the chassis 80 of a further operating table column 82 according to a second embodiment. The chassis 80 of the operating table column 82 is employed alternatively to the operating table column 14 and differs in the formation of the guide means for guiding a lateral movement of the area of intersection between the lifting cylinder 34 and the plane E. The other elements of this second embodiment, which are partly not shown, are formed and arranged like in the first embodiment.

In contrast to the first embodiment, the further guide means 74 is formed differently from the guide means 36. The guide means 74 is connected to the chassis 80 via a first bridge 76 and a second bridge 78. Preferably, the guiding bush 33, the bridges 76, 78 and the guide means 74, as well as the chassis 80 are integrally formed from one block of material or as an integral cast piece. Therein, the longitudinal axes of the first bridge 76 and the second bridge 78 are each arranged parallel to the Y-axis. In particular, the first bridge 76 and the second bridge 78 are formed so as to be thinner in direction of the X-axis than in direction of the Y-axis such that the first bridge 76 and the second bridge 78 are elastically deformable when a force is applied to the guide means 74 acting in the direction of the X-axis.

In the guide means 74, a guiding aperture 70 is provided through which the cylinder barrel 34*a* is fed so as to be capable of sliding through the guiding aperture 70 during a driving motion of the lifting cylinder 34. The cylinder barrel 34*a* fed through the guiding aperture 70 is thereby movable in the plane E along the X-axis by a distance having a maximum length within the range of 0 mm to 1 mm. Thus, the manufacturing and mounting tolerances regarding the distance between the cylinder barrel 34*a* and the primary guide which particularly show during extension of the lifting cylinder 34 can be compensated for via the movement of the guide means 74. The first bridge 76 and the second bridge 78 are not bendable in direction of the Y-axis such that the cylinder barrel 34*a* and the lifting carriage 40 connected thereto are guided in a stable manner along the Y-axis when lateral forces are present, and in particular do not perform any rotational movement about the longitudinal axis L1 of the guide bar 32.

The embodiments of the invention described above are provided by way of example only. The skilled person will be aware of many modifications, changes and substitutions that could be made without departing from the scope of the present invention. The claims of the present invention are intended to cover all such modifications, changes and substitutions as fall within the spirit and scope of the invention.

What is claimed is:

1. A device for height adjustment of an operating table, including a lifting carriage which is movable relative to a chassis of the operating table, including a primary guide having a first longitudinal axis (L1) about which the lifting carriage is rotatable, including a secondary guide having a second longitudinal axis (L2), and including a guide which is connected to the chassis of the operating table and which has a contact area in which the guide contacts the secondary guide in a contact area of the secondary guide, wherein the primary guide and the secondary guide serve for guiding a lifting motion of the lifting carriage within an adjustment range of the lifting carriage parallel to the first longitudinal axis (L1), wherein a plane (E) extending perpendicular to the first longitudinal axis (L1) and through the guide has a first point of intersection (S1) with the first longitudinal axis (L1) and a second point of intersection (S2) with the second longitudinal axis (L2), wherein the position (P1, P2) of the second point of intersection (S2) changes by a displacement distance during the lifting motion of the lifting carriage within the adjustment range thereof, and wherein the connection between the guide and the chassis permits a compensating motion of the guide such that the contact area of the guide is shiftable by said displacement distance.

2. The device according to claim 1, wherein the position (P1, P2) of the second point of intersection (S2) changes from a first position (P1) prior to the lifting motion of the lifting carriage to a second position (P2) after the lifting motion of the lifting carriage, and during the compensating motion, the contact area of the guide is shifted together with the secondary guide upon a displacement of the second point of intersection (S2) from the first position (P1) to the second position (P2).

3. The device according to claim 2, wherein an X-axis (X) lies in the plane (E), and an Y-axis lies in the plane (E) so as to be orthogonal to the X-axis, with the X-axis intersecting the first longitudinal axis (L1) and the secondary guide, and the connection between the guide and the chassis permits the compensating motion along a path between the first position (P1) and the second position (P2) such that the length of the projection (PY) onto the Y-axis (Y) of the distance between the first position (P1) and the second position (P2) is smaller than the length of the projection (PX) onto the X-axis (X) of the distance between the first position (P1) and the second position (P2).

4. The device according to claim 1, wherein the connection between the guide and the chassis permits the compensating motion of the guide only such that during the lifting motion of the lifting carriage within the adjustment range thereof, the second point of intersection (S2) moves on a predetermined trajectory in the plane (E).

5. The device according to claim 1, wherein the primary guide comprises a guide bar and a guiding bush arranged in the chassis, wherein the first longitudinal axis (L1) is the longitudinal axis (L1) of the guide bar, wherein the guide bar is fixedly connected to the lifting carriage at each of a first end and a second end opposite the first end, and is moved together with the lifting carriage during the lifting motion thereof, and wherein the guide bar is fed through the guiding bush in a sliding manner, wherein the secondary guide comprises a guide element formed as a rod or a cylinder barrel, wherein a first end of the guide element and a second end of the guide element opposite the first end each are fixedly connected to the lifting carriage, and wherein the guide element is fed through the contact area of the guide in a sliding manner.

6. The device according to claim 1, wherein the guide rod has a circular cross section having a diameter within the range of 25 mm to 80 mm.

7. The device according to claim 5, wherein the primary guide has at least one contact area via which the guiding bush contacts the guide bar, wherein the contact area of the primary guide has a length within the range of 120 mm to 210 mm and parallel to the first longitudinal axis (L1).

8. The device according to claim 1, wherein the secondary guide is formed by a cylinder barrel of a lifting cylinder serving as lifting carriage drive, and one end of the piston rod of the lifting cylinder is fixedly connected to the chassis of the operating table.

9. The device according to claim 1, wherein the guide has a first aperture forming the contact area of the guide through which aperture a portion of the secondary guide is fed in a sliding manner.

10. The device according to claim 9, wherein the first aperture of the guide and a portion of the secondary guide form a slide bearing in which the secondary guide is movable relative to the guide along the second longitudinal axis (L2).

11. The device according to claim 9, wherein the lifting carriage drive is a lifting cylinder, and the lifting cylinder is a double-acting and/or hydraulic lifting cylinder, and that a portion of the lateral surface of the cylinder barrel is fed through the first aperture of the guide in a sliding manner.

12. The device according to claim 1, wherein the guide is connected to the chassis of the operating table so as to be pivotable about a rotational axis parallel to the first longitudinal axis (L1), and in a neutral position of the guide, a radial axis (R) lying in the plane (E) and intersecting each of the rotational axis and the second longitudinal axis (L2) at right angles is perpendicular to the X-axis.

13. The device according to claim 1, wherein the only compensating motion permitted by the connection of the guide to the chassis during a lifting motion of the lifting carriage in the plane (E) extends along a line connecting the first point of intersection (S1) and the second point of intersection (S2).

14. The device according to claim 1, wherein the lifting carriage is connected to a first end of each of a first linear actuator and a second linear actuator for adjusting the height and/or tilt of a column head of the operating table.

15. An operating table including a device for height adjustment of a patient support according to claim 1, wherein the patient support is connected to a column head of the operating table, the guide has a plate or plate-shape profile, and wherein the height of the column head is variable by movement of the lifting carriage.

16. The device according to claim 2, wherein the connection between the guide and the chassis permits the compensating motion of the guide only such that during the lifting motion of the lifting carriage within the adjustment range thereof, the second point of intersection (S2) moves on a predetermined trajectory in the plane (E).

17. The device according to claim 3, wherein the connection between the guide and the chassis permits the compensating motion of the guide only such that during the lifting motion of the lifting carriage within the adjustment range thereof, the second point of intersection (S2) moves on a predetermined trajectory in the plane (E).

18. The device according to claim 2, wherein the primary guide comprises a guide bar and a guiding bush arranged in the chassis, wherein the first longitudinal axis (L1) is the longitudinal axis (L1) of the guide bar, wherein the guide bar is fixedly connected to the lifting carriage at each of a first end and a second end opposite the first end, and is moved together with the lifting carriage during the lifting motion thereof, and wherein the guide bar is fed through the guiding bush in a sliding manner, wherein the secondary guide comprises a guide element formed as a rod or a cylinder barrel, wherein a first end of the guide element and a second end of the guide element opposite the first end each are fixedly connected to the lifting carriage, wherein the guide element is fed through the contact area of the guide in a sliding manner.

19. The device according to claim 3, wherein the primary guide comprises a guide bar and a guiding bush arranged in the chassis, wherein the first longitudinal axis (L1) is the longitudinal axis (L1) of the guide bar, wherein the guide bar is fixedly connected to the lifting carriage at each of a first end and a second end opposite the first end, and is moved together with the lifting carriage during the lifting motion thereof, and wherein the guide bar is fed through the guiding bush in a sliding manner, wherein the secondary guide comprises a guide element formed as a rod or a cylinder barrel, wherein a first end of the guide element and a second end of the guide element opposite the first end each are fixedly connected to the lifting carriage, wherein the guide element is fed through the contact area of the guide in a sliding manner.

20. The device according to claim 4, wherein the primary guide comprises a guide bar and a guiding bush arranged in the chassis, wherein the first longitudinal axis (L1) is the longitudinal axis (L1) of the guide bar, wherein the guide bar is fixedly connected to the lifting carriage at each of a first end and a second end opposite the first end, and is moved together with the lifting carriage during the lifting motion thereof, and wherein the guide bar is fed through the guiding bush in a sliding manner, wherein the secondary guide comprises a guide element formed as a rod or a cylinder barrel, wherein a first end of the guide element and a second end of the guide element opposite the first end each are fixedly connected to the lifting carriage, wherein the guide element is fed through the contact area of the guide in a sliding manner.

21. A device for height adjustment of an operating table, including a lifting carriage which is movable relative to a chassis of the operating table, including a primary guide having a first longitudinal axis (L1) about which the lifting carriage is rotatable, including a secondary guide having a second longitudinal axis (L2), and including a guide means which is connected to the chassis of the operating table and which has a contact area in which the guide means contacts the secondary guide in a contact area of the secondary guide, wherein the primary guide and the secondary guide serve for guiding a lifting motion of the lifting carriage within an adjustment range of the lifting carriage parallel to the first longitudinal axis (L1), wherein a plane (E) extending perpendicular to the first longitudinal axis (L1) and through the guide means has a first point of intersection (S1) with the first longitudinal axis (L1) and a second point of intersection (S2) with the second longitudinal axis (L2), wherein the position (P1, P2) of the second point of intersection (S2) changes by a displacement distance during the lifting motion of the lifting carriage within the adjustment range thereof, and wherein the connection between the guide means and the chassis permits a compensating motion of the guide means such that the contact area of the guide means is shiftable by said displacement distance.

* * * * *